US005123181A

United States Patent [19]

Rosen

[11] Patent Number: 5,123,181

[45] Date of Patent: Jun. 23, 1992

[54] ADJUSTABLE GIRTH SHOE CONSTRUCTION

[76] Inventor: Henri E. Rosen, 229 Coolidge Ave., Watertown, Mass. 02172

[21] Appl. No.: 639,003

[22] Filed: Jan. 9, 1991

[51] Int. Cl.[5] ..... A43B 3/26

[52] U.S. Cl. ..... 36/97; 36/93

[58] Field of Search ..... 36/97, 93, 101, 9 R, 36/15

[56] References Cited

U.S. PATENT DOCUMENTS

| | | | |
|---|---|---|---|
| 3,404,468 | 10/1968 | Rosen | 36/97 X |
| 3,541,708 | 11/1970 | Rosen | 36/97 |
| 3,686,777 | 8/1972 | Rosen | 36/97 |
| 3,693,269 | 9/1972 | Guarrera | 36/15 |
| 4,279,083 | 7/1981 | Dilg | 36/101 |
| 4,343,057 | 8/1982 | Bensley | 36/101 X |
| 4,439,935 | 4/1984 | Kelly | 36/15 X |
| 4,858,341 | 8/1989 | Rosen | 36/88 X |

FOREIGN PATENT DOCUMENTS 2178940 2/1987 United Kingdom .

*Primary Examiner*—Paul T. Sewell
*Assistant Examiner*—Ted Kavanaugh
*Attorney, Agent, or Firm*—Bruce F. Jacobs

[57] ABSTRACT

An improved shoe construction is disclosed which affords manually operable girth adjustment by a shoe upper having a widthwise adjustable bottom section and substantially hidden girth adjusting removably attachable fastener positioned between the bottom section of shoe upper and the sole.

12 Claims, 2 Drawing Sheets

ADJUSTABLE GIRTH SHOE CONSTRUCTION

BACKGROUND OF THE INVENTION

The need for simple and practical means of obtaining girth adjustment in footwear is acknowledged in the shoe industry and growing as continually more shoe offerings are being limited by marketing economics to single widths for each size length. Studies, including those of the U.S. Army QMC, have shown that such single width shoes fit less than one third of the public, and this fraction diminishes still further with the dynamic girth changes experienced by a foot principally from the normal changes in fluid accumulation in the extremities. Such changes are quite significant, usually averaging 1½ full width increments or 'sizes' on a daily basis, with appreciably greater variations being experienced with changes in weather, altitude, or the wearer's physical condition.

To date, the most popular method of girth adjustment is by the shoelace, which affords moderate adjustability in the waist and instep region, but rarely extends to the ball area where lacing or buckle or hook and loop fastener arrangements can be uncomfortable due to the continual flexing thereof during the stride.

The shoes disclosed in U.S. Pat. Nos. 3,541,708 and 3,686,777 proved impractical due to their complexity and resulting high costs. U.S. Pat. No. 3,404,468, however, of which this invention is an improvement, combined simplicity with a most comfortable end product. The '468 shoe, however, proved to be only marginally marketable due to the unacceptable appearance of the sides of the shoe where the upper was not directly attached to the bottom, as well as the tendency of the design to trap pebbles and other debris between the upper and the sole elements.

Past attempts to utilize hook and loop-type detachable fasteners in shoes have been many and varied. For instance, U.S. Pat. No. 2,952,925 discloses the use of stretch-type material for adjusting the width of shoe uppers in combination with a two-part shank for varying the length of the shoe. The two shank portions are detachably connected by a hook and loop type touch fastener. U.S. Pat. No. 3,618,235 discloses the use of a split toe section of a shoe and a tongue-like element, secured to the front of the toe and detachably connected to the shoe by a Velcro fastening means, to cover the opening in the split toe section. U.S. Pat. No. 4,279,083 discloses the use of a hook and loop detachable fastening means to attach a complete replaceable sole to a shoe body.

Past attempts to deal with the girth adjustment problem have not proven commercially viable, primarily because the attachment means were not completely invisible when the shoe was worn. The unattractiveness of the attachment means and the lack of substantial invisibility of them has caused them to be non-competitive with most popular conventionally styled footwear.

Accordingly, it is one of the objects of the present invention to provide a shoe width girth adjustment in all of the critical fitting areas of a shoe including the mid-portion areas of ball, waist, and instep. It is an object to provide an adjustment means which is substantially completely hidden so it does not detract from the appearance and styling potential of the shoe. It is still another object to provide an adjustment means which is manually adjustable by the wearer when the shoe is on the foot to provide proper fit.

SUMMARY OF THE INVENTION

According to the present invention the shoe comprises an upper having a widthwise adjustable bottom section which is at least partially detachably connected to a sole assembly, with girth adjustment removably attachable fastener means positioned between the upper and the sole assembly to afford easy adjustment of the effective girth of said shoe.

In a preferred embodiment, the girth adjusting means comprises a Velcro® type hook and loop 'touch' fastener, preferably by using the recently developed Vel-Stretch® stretchable loop material as the bottom section of the upper to provide a secure yet detachable fastening between the bottom section of the shoe upper and a hook material on the top surface of the sole assembly. Alternatively, the detachable fastening may be accomplished by means of pressure-sensitive adhesives and sheet materials.

For a fuller understanding of the nature and objects of the present invention, reference should be made to the following detailed description taken in connection with the accompanying drawings.

DETAILED DESCRIPTION OF THE INVENTION

Figure 1:
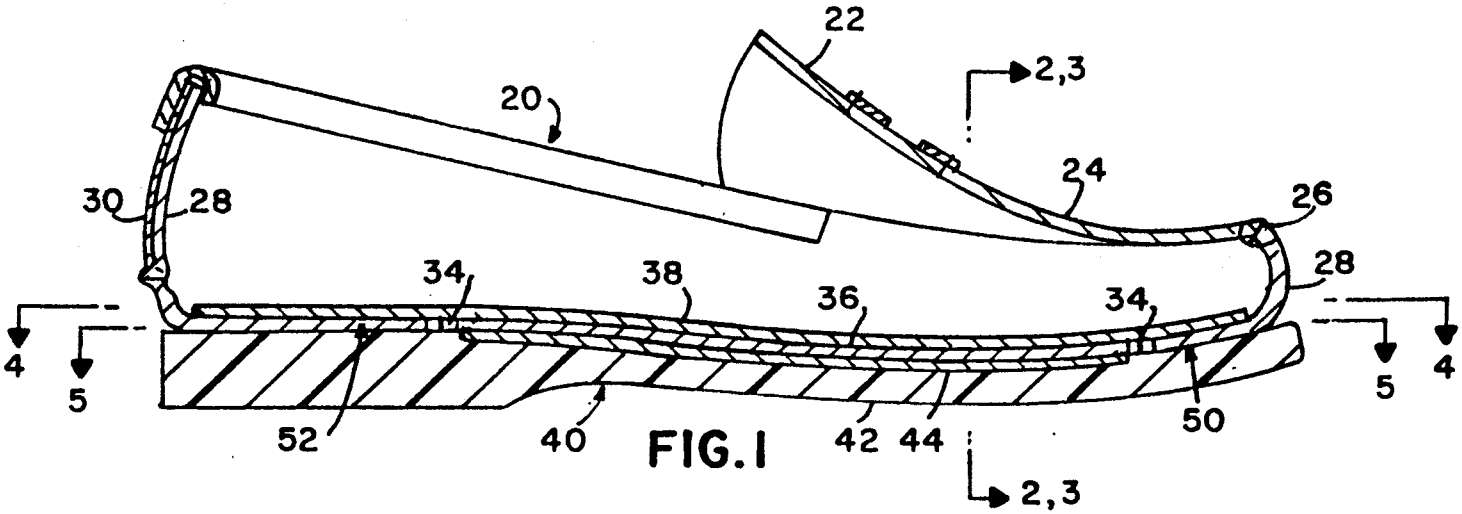
FIG. 1 is a side-elevational cross-sectional view of a shoe embodying principles of the present invention.

Referring to the drawings, the improved adjustable girth shoe construction of the present invention will be described with reference to the well-known loafer designed casual shoe. It should be understood that this is being done for ease of reference and that the invention is not limited to use in any one style of shoe but rather is readily applicable to many other styles and categories of footwear as well. In the various embodiments described hereinafter, like reference numerals refer to like members which function in the same or a similar manner.

As best shown in the drawings, shoe 20 comprises an upper 22 having a plug 24, attached preferably by stitching at seam 26 to vamp 28. The seam 26 extends substantially around the forepart of upper 22. Upper 22 also includes a backtab or counter pocket 30 attached preferably by stitching to vamp 28 and cuff or collar 32 stitched and turned to cover the top edges of the vamp 28 and tab 30. The upper 22 may be any conventional shoe upper material such as leather or fabric.

The bottom section 23 of upper 22 is elastically stretchable and is preferably attached to both lower side marginal edges 25 of vamp 28, preferably by zig-zag stitching 34. In addition, the bottom section 23 is either attached to or includes the part 36 of a girth adjustment means. The other part of the adjustment means comprises member 44 which is attached to a sole assembly 40 by a suitable means such as an adhesive or stitching. While the parts of the adjustment means may be placed adjacent to or along the lower side marginal edges 25 of vamp 28, preferably they extend over the complete bottom section 23 of the upper 22 and the upper surface of the sole assembly 40. Preferably the toe region 50 and the heel region 52 do not contain the adjustment means. Members 36 and 44 are positioned so that they detachably connect to each other and are concealed from view when the shoe is being worn. In the heel and toe regions, the upper 22 is preferably permanently attached to the sole assembly 40. The term "sole assembly" as used herein includes both multipiece assemblies and unitsoles.

Figure 4:
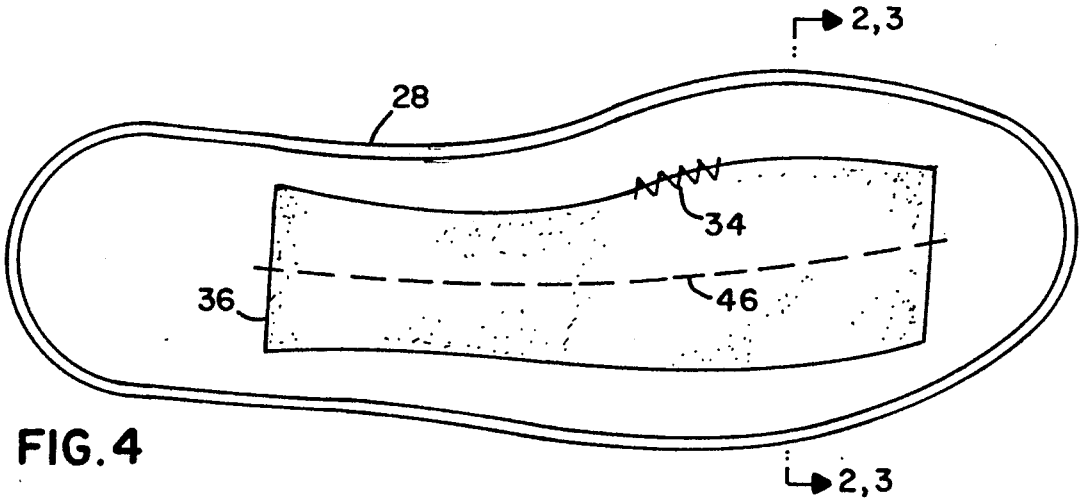
FIG. 4 is a plan view of the inside portion underneath the insertable sock of the shoe of FIG. 1 taken along the line 4—4 thereof.
Figure 5:
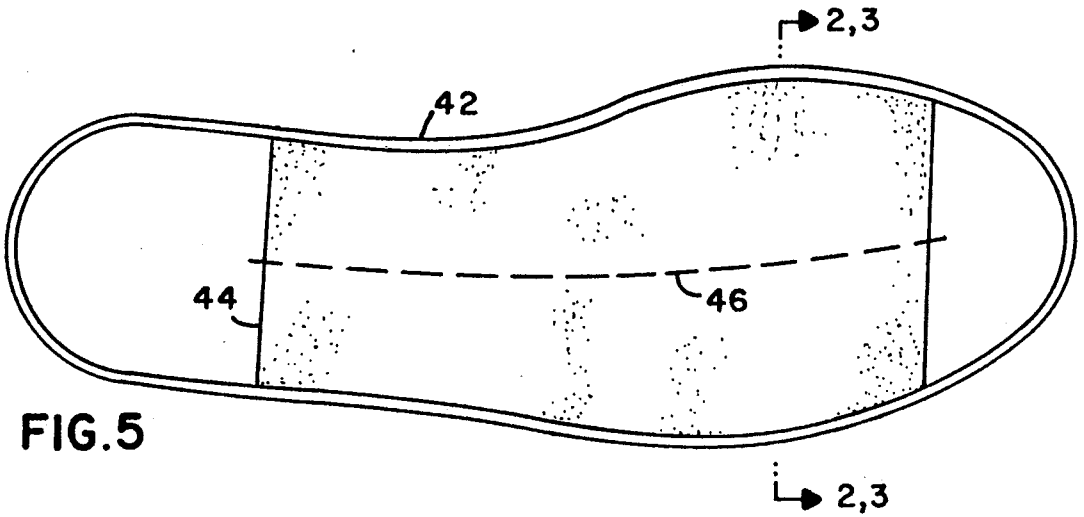
FIG. 5 is a plan view of the bottom assembly of the shoe of FIG. 1 taken along the line 5—5 thereof.

While any suitable detachable-reattachable adjustment means may be employed, it is presently preferred to employ hook and loop type fasteners which are sometimes referred to as Velcro® type fasteners. As shown, the hook portion of the fastener may be member 36 and the loop fastener may be member 44 or vice-versa. Member 36, whether a hook or loop sheet material, is elastically stretchable to accomplish the girth adjustment. A stretchable loop material Vel-Stretch®, manufactured by Velcro-USA, Manchester, N.H., is presently preferred. In the alternative, members 36 and 44 may be sheets of pressure sensitive adhesive materials. As shown, the shoe also contains a removable sock insert 38. Additionally, as best shown in FIGS. 4–5, an optional but preferred line of stitching 46, permanently fastening the longitudinally central position of the bottom section 23 of upper 22 to the sole assembly 40, is used so that transverse adjustment of the upper 22 will tend to be centrally balanced relative to the longitudinal centerline of the shoe.

Figure 3:
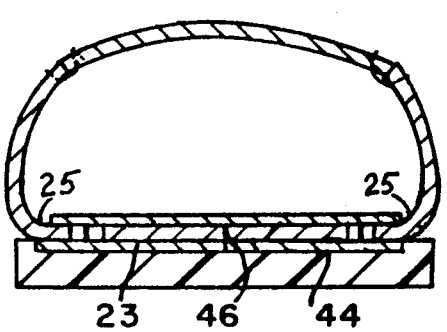
FIG. 3 is a transverse cross-sectional view of the shoe of FIG. 1 taken along the line 3—3 thereof and showing the shoe adjusted to the girth of a relatively wider foot than in FIG. 2.
Figure 2:
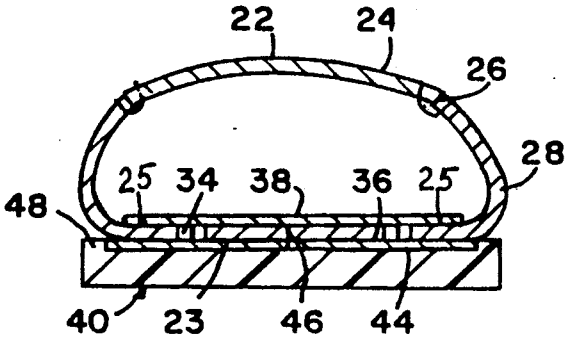
FIG. 2 is a transverse cross-sectional view of the shoe of FIG. 1 taken along the line 2—2 thereof and showing the shoe adjusted to the girth of a relatively narrow foot.

Adjustment of the girth of the shoe is effected by detaching member 36 from member 44 and thereby partially detaching the the upper 22 from the sole assembly 40. Once detached the upper 22 and member 36 are free to stretch transversely. Such adjustment and stretching is best accomplished when the shoe is being worn. After the stretching takes place, pressure is employed to re-attach the upper 22 to the sole assembly 40. Adjustment from a lesser girth (FIG. 2) to a greater girth (FIG. 3) is best shown in FIGS. 2 and 3. Girth adjustment of up to 4 full width increments may be effected using this shoe construction.

In an alternative embodiment of this invention (not shown), the bottom section 23 of the upper 22 is omitted and the members 36 of the girth adjustment means is attached to each of the side marginal edges of the upper 22 which are not attached to each other. The edges extend into the area which would have been used by the bottom section.

In a further alternative embodiment of this invention (not shown), the bottom section 23 of the upper 22 is omitted; member 36 of the girth adjustment means is attached to each of the side marginal edges of the upper 22; and said side marginal edges are attached to a girth adjustment means disposed inside the shoe as disclosed in copending application U.S. Ser. No. 07/441,978, filed Nov. 28, 1989, the subject matter of which is hereby incorporated herein by reference.

In a further alternative embodiment of this invention, an edge element 48 as shown in FIG. 2 located along the outer peripheral side edges of the shoe may be used to prevent dirt or foreign matter from entering into the area of the attachment means and possibly interfering in the operation thereof. Such an edge element which can be a folded, extruded, or edge stitched stripping which is preferably permanently attached to both the upper and the sole assembly and is sufficiently flexible that it moves to permit inward or outward movement of the upper relative to the sole assembly while blocking the entrance of foreign matter therebetween.

What is claimed is:

1. An adjustable shoe comprising an upper member having side sections and opposing side marginal edges; a sole assembly having an upper surface; and a means for adjusting the girth of the shoe by allowing the side marginal edges of the upper member to move; said adjustment means comprising two separate parts, one of said parts being elastically stretchable and permanently attached to the side marginal edges of the upper member and the other part being permanently attached to the upper surface of the sole assembly, said two parts being substantially detachably connected to each other.

2. The adjustable shoe of claim 1, wherein the adjustment means comprises a pressure sensitive adhesive material.

3. The adjustable shoe of claim 1, wherein one of the parts is a loop portion of a touch fastener and the other part is a hook portion of a touch fastener.

4. The adjustable shoe of claim 1, further containing an edge element attaching the upper member to the sole assembly around the peripheral edge of the shoe.

5. An adjustable shoe comprising an upper member having side sections, opposing lower side marginal edges and a widthwise adjustable bottom section connected between said marginal edges, said bottom section having a lower surface; a sole assembly having an upper surface; and a means for adjusting the girth of the shoe by allowing the bottom section of the upper member to change in width; said adjustment means comprising two separate parts, one of said parts being elastically stretchable and permanently attached to the lower surface of the bottom section of the upper member and the other part being permanently attached to the upper surface of the sole assembly, said two parts being substantially detachably connected to each other.

6. The adjustable shoe of claim 1, wherein the bottom section is elastically stretchable.

7. The adjustable shoe of claim 1, wherein the adjustment means comprises a pressure sensitive adhesive material.

8. The adjustable shoe of claim 1, wherein one of the parts is a loop portion of a touch fastener and the other part is a hook portion of a touch fastener.

9. The adjustable shoe of claim 1, wherein the bottom section of the upper member has a center portion which is permanently attached to said sole assembly along at least a portion of the longitudinal center of said sole assembly.

10. The adjustable shoe of claim 9, wherein stitching is the permanent attachment.

11. The adjustable shoe of claim 1, wherein the adjustment means comprises a pressure sensitive adhesive sheet material.

12. The adjustable shoe of claim 1, further containing an edge element attaching the upper member to the sole assembly around the peripheral edge of the shoe.

* * * * *